US005437257A

United States Patent [19]

Giacomazzi et al.

[11] Patent Number: 5,437,257

[45] Date of Patent: Aug. 1, 1995

[54] EVAPORATIVE EMISSION CONTROL SYSTEM WITH VENT VALVE

[75] Inventors: Roy A. Giacomazzi, Rochester Hills; Gregory E. Rich, Richmond; Chester W. Przeklas, Mt. Clements, all of Mich.; Kenneth W. Turner, Webster, N.Y.

[73] Assignee: General Motors Corporation, Detroit, Mich.

[21] Appl. No.: 202,626

[22] Filed: Feb. 28, 1994

[51] Int. Cl.[6] ..... F02M 33/02

[52] U.S. Cl. ..... 123/520; 123/198 D

[58] Field of Search ..... 123/520, 198 D, 516, 123/518, 519, 521

[56] References Cited

U.S. PATENT DOCUMENTS

| | | | |
|---|---|---|---|
| 4,173,207 | 11/1979 | Hirmatsu | 123/519 |
| 4,338,106 | 7/1982 | Mizuno | 123/519 |
| 4,817,576 | 4/1989 | Abe | 123/518 |
| 4,846,135 | 7/1989 | Tiphaine | 123/520 |
| 4,951,637 | 8/1990 | Cook | 123/520 |
| 5,065,782 | 11/1991 | Szlaga | 137/39 |
| 5,083,546 | 1/1992 | Detweiler et al. | 123/520 |
| 5,146,902 | 9/1992 | Cook et al. | 123/518 |
| 5,148,793 | 9/1992 | Reddy | 123/520 |
| 5,156,178 | 10/1992 | Harris | 137/43 |
| 5,158,054 | 10/1992 | Otsuka | 123/198 D |
| 5,174,265 | 12/1992 | Sekine | 123/520 |
| 5,191,870 | 3/1993 | Cook | 123/520 |
| 5,193,512 | 3/1993 | Steinbrenner et al. | 123/520 |
| 5,235,955 | 8/1993 | Osaki | 123/520 |
| 5,245,975 | 9/1993 | Ito | 123/520 |
| 5,253,629 | 10/1993 | Fornuto et al. | 123/519 |
| 5,263,462 | 11/1993 | Reddy | 123/520 |
| 5,289,811 | 3/1994 | Couert | 123/520 |
| 5,317,909 | 6/1994 | Yamada | 123/520 |

FOREIGN PATENT DOCUMENTS

| | | | |
|---|---|---|---|
| 2054939 | 5/1992 | Canada . | |
| 0055226 | 5/1979 | Japan | 123/520 |
| 0060423 | 3/1989 | Japan | 123/519 |

OTHER PUBLICATIONS

"Evaporative Emission (EVAP) Control System", Section C3, Vehicle Service Manual, General Motors Corporation, 1992.

*Primary Examiner*—Carl S. Miller

*Attorney, Agent, or Firm*—Jeffrey A. Sedlar

[57] ABSTRACT

An evaporative emission control system of an internal combustion engine's fuel system including a vent valve. The vent valve provides a mechanism for closing the evaporative emission control system creating a pressure differential between system and atmospheric under various conditions whereby the system can be automatically diagnosed. The vent valve relieves pressure or vacuum in the system that exceeds a threshold necessary to detect the presence of leaks. The vent valve includes a vacuum actuator providing a low restriction flow path for system purges.

4 Claims, 1 Drawing Sheet

EVAPORATIVE EMISSION CONTROL SYSTEM WITH VENT VALVE

BACKGROUND OF THE INVENTION

The present invention pertains to an evaporative emission control system for a vehicle. More particularly, the invention is directed to a system with a vent valve installed in a vent from the evaporative emission control system storage canister for use in system diagnosis.

Automobiles currently include a system for the collection and processing of fuel evaporate created by fuel carried in the fuel system of the automobile, primarily the storage tank. The type of evaporative emission control system involved in the present invention is the evaporative emission canister storage method. This method is comprised of a mechanism to transfer fuel vapor and air emanating from the fuel tank to a canister typically containing activated carbon as an adsorbent for adsorption, storage and later recovery of the vapor.

Adsorption is a reversible process in which gas or liquid particles adhere in a thin film to the surface area of the solid adsorbent. The fuel vapor that is collected in the storage canister is held by the adsorbent when the vehicle is not operating and under certain operating conditions. When the vehicle's engine is running and selected operating criteria are met the vapors are purged from the adsorbent. During the purge cycle, the stored fuel vapor is stripped from the adsorbent by passing ambient air through the adsorbent bed and then mixing it with the intake air flow of the engine for consumption in the normal combustion process. The adsorbent is thereby regenerated by the purge cycle.

The adsorption-desorption process is dynamic and ongoing with the cyclic operation and parking of an automobile that results from a typical operator's use of the vehicle for transportation. Vapors emitted during periods the vehicle is parked are adsorbed and then later desorbed when the vehicle is driven. It is important to provide a free flow of air through the canister during the purge cycle to thoroughly strip the stored vapor from the adsorbent. This results in thorough desorption while the vehicle is in operation thereby providing adsorption capacity for later parked periods.

The storage canister of the evaporative emission control system generally has three port openings leading to the adsorbent bed. A first opening is connected to a line that allows air and fuel vapor to pass from or to the vehicle's fuel tank according to pressure gradients in the tank. A second opening is connected to a line leading to the intake manifold of the vehicle's engine allowing purged vapor and air to pass to the engine according to selected engine operating conditions. The third opening is typically vented to the atmosphere allowing the canister to breathe freely.

By permitting air flow between the canister and atmosphere, the vent facilitates evaporate transfer between the canister and fuel tank and supplies air for canister purge. The vent permits fuel tank evaporate to enter the canister during periods of rising pressure within the tank by acting as a pressure relief point for the system. Evaporate may also return to the tank from the canister during periods of falling pressure in the tank, with the vent relieving vacuum in the system by providing an air entry point. Additionally, during a purge cycle air is drawn through the vent into the adsorbent bed of the canister stripping evaporate and carrying it to the engine for consumption. The vent to the atmosphere is therefore, an essential component of the evaporative emission control system.

The system, generally as described, was introduced to use in automobiles to reduce hydrocarbon emissions from the fuel system of vehicles and is in widespread use in automobiles today. The most common current mechanism for diagnosing existing evaporative emission control systems is through manual inspection and testing of a system. However, technology has progressed to the point that efforts have been made to provide an automatic mechanism to diagnose systems. Attempts have been made to close systems to a greater extent and provide an automatic diagnostic means. Automatic systems known in the art generally include a valve in the evaporative emission control system's canister vent that is coupled to the vehicle's electronic control module or electrical system.

SUMMARY OF THE INVENTION

This invention is directed to a device that: (A) provides a high degree of vapor closure to an automobile's evaporative emission control system while still allowing free flow of purge air into the system, (B) aids in the automatic detection of system malfunctions, (C) functions automatically, independent of the vehicle's electric and electronic systems, and (D) can be utilized with minimal changes to a present evaporative emission control system.

This device comprises a vent valve having two flow ports with a combination of two flow paths within the valve. The flow paths define two parallel routes through the valve between the flow ports. Each flow path includes an independently acting normally closed valve. A first operator opens one valve at a subatmospheric reference value permitting flow at a selected negative system pressure. A second operator opens the other valve at a superatmospheric reference value permitting flow at a selected positive system pressure and is also actuated by engine intake manifold vacuum pressure at a selected subatmospheric reference value. This valve permits the system to breathe as is required for proper operation while at the same time closes the system according to preset conditions for use in automatically diagnosing the system.

The evaporative emission control system of the present invention includes a storage canister containing an adsorbent material preferably activated carbon. This canister receives and stores fuel evaporate. A connection from the canister is provided to the vehicle's fuel tank to allow evaporated fuel to enter the canister for collection. The canister is also connected to the vehicle's engine intake manifold. This connection includes a solenoid valve that activates and deactivates the purge cycle whereby fuel vapors stored in the canister can be transferred to the engine and consumed during selected engine operating conditions. The vacuum created by the induction system of the engine draws purged vapors from the canister for burning during the normal combustion process along with fuel from the vehicle's fuel supply system.

Also connected to the canister is a vent line leading to the system's vent valve which incorporates the features of this invention. The vent valve includes two flow ports. One flow port is connected to the vent line leading to the adsorbent bed of the canister. The other port opens to the atmosphere. The vent valve controls flow in both directions between the adsorbent bed and the atmosphere. Flow through the vent valve is controlled by the dually arranged valve and flow path system.

The vent valve provides several important functions. Flow is actuated under a plurality of system and vehicle conditions. When the vehicle's engine is running an engine manifold signal opens the valve providing a low restriction flow path for purge air into the canister. Purge air freely flows to the canister stripping fuel vapors that have been stored in the adsorbent material and carrying them through the purge line to the engine for consumption when the purge solenoid valve is open.

The evaporative emission control system vent valve provides an integral part of a diagnostic mechanism for analyzing system parameters. When the engine is off the valve closes sealing the evaporative emission control system from the atmosphere causing pressure to build up. The build up of pressure may be either positive or negative within the system due to external environmental conditions causing a temperature change in the tank or hot soak causes. The pressurized system provides a mechanism whereby sensors can be used to supply information to the vehicle's electronic system or other equivalent apparatus for analysis of the system's functions.

If negative or positive pressure within the system increases beyond a threshold level necessary to detect the presence of malfunctions, such as a leak, the vent valve vents the excess pressure to the atmosphere. This function serves to avoid high levels of pressure in the system and permits back flow of vapor into the vehicle's fuel tank under negative pressure conditions resulting in reduced canister loading.

An aspect of the present invention is that the vent valve does not require electrical power to operate and is not controlled by the vehicle's electronic controls. As a result there is no power drain when the vehicle is off and no direct connection between the valve itself and the vehicle's electronic control module is required. The provision for an engine manifold vacuum actuator integral with the positive system pressure control valve of the vent valve yields the benefit of a low restriction flow path for purge cycle air flow.

The evaporative emission control system vent valve according to the present invention closes the vent to the atmosphere while the vehicle is parked except under extra pressure conditions. By thus closing the system and allowing pressure to build under conditions which would normally be expected to result in a pressure gradient within the system, malfunctions in the vehicle's evaporative emission control system can be detected via the electronic control module of the vehicle. The vehicle's electronics can in turn notify the operator of the system's service requirements.

The above stated objects features and advantages of the invention along with others will become apparent from the following description and illustration of the invention and the presently preferred embodiment thereof.

DETAILED DESCRIPTION OF THE PRESENTLY PREFERRED EMBODIMENTS

Figure 1:
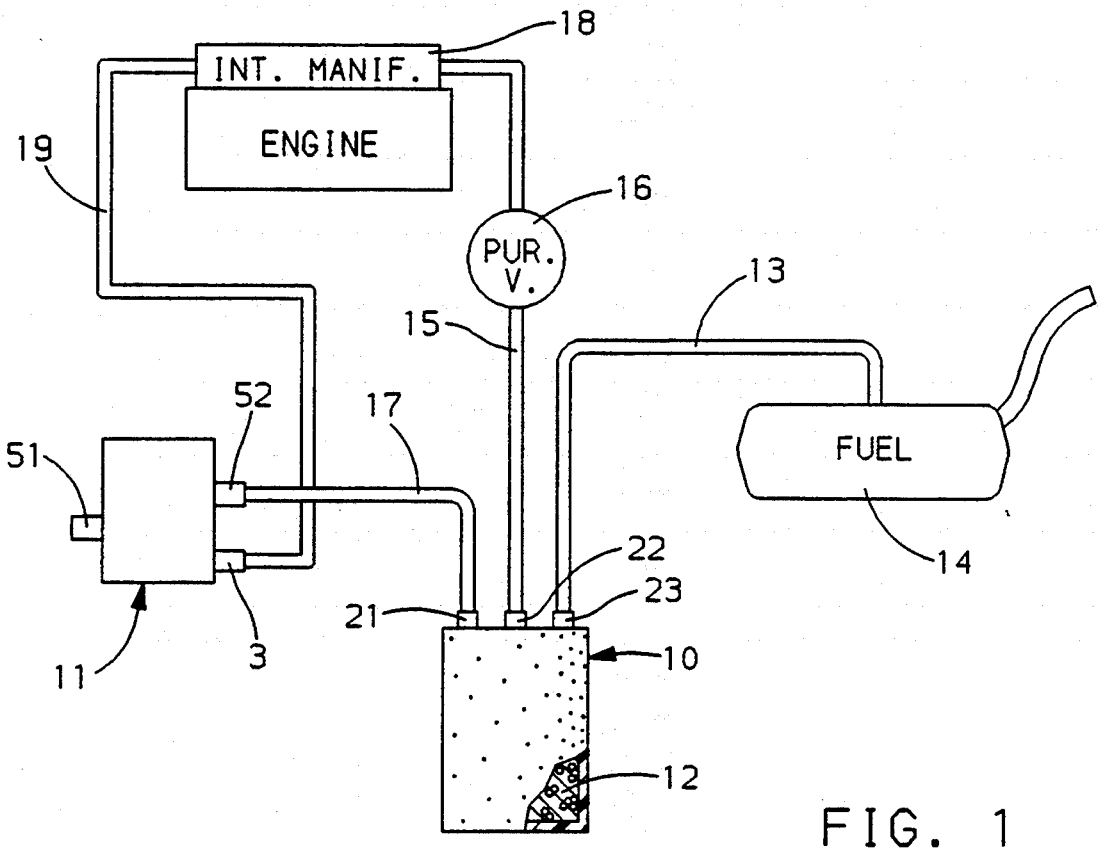
FIG. 1 is a schematic of the basic components of an evaporative emission control system according to the present invention including the system's vent valve.

FIG. 1 illustrates an evaporative emission control system of an automobile employing principles of the present invention. This system includes a vapor storage canister 10 containing an adsorbent bed 12 typically activated carbon. This canister provides a closed container for the adsorbent bed 12 with the exception of three port openings 21, 22 and 23. Opening 23 is connected to the vehicle's fuel tank 14 via a conduit identified as vapor line 13. Through this connection fuel evaporate may exit the tank 14 travel through vapor line 13, enter the canister 10 and be adsorbed by the adsorbent 12. Vapor line 13 also provides a route whereby decreases in system pressure below atmospheric will draw air into the canister through vent line 17 to strip vapors held in the adsorbent 12 and carry them back to the fuel tank 14. Therefore, a vent is provided through canister opening 21 for tank 14 as is necessary for a container carrying a variable fluid volume.

Canister opening 22 is connected to a conduit identified as purge line 15 which leads to the vehicle's engine intake manifold system 18. Positioned in purge line 15 is valve 16 that activates and deactivates flow thereby controlling the purge cycle of the adsorbent 12. Purge valve 16 is preferably a solenoid operated valve controlled by a conventional vehicle electronic controller (not illustrated). This purge solenoid is normally closed when the vehicle is not running. Valve 16 is typically opened and purge initiated when the engine is running above idle speed. When valve 16 is open atmospheric air is drawn in through vent line 17 and passes through the adsorbent bed 12 mixing with stored fuel vapor. The air-vapor mixture is then drawn through purge line 15 into the intake manifold of the engine 18 where it is consumed.

Figure 2:
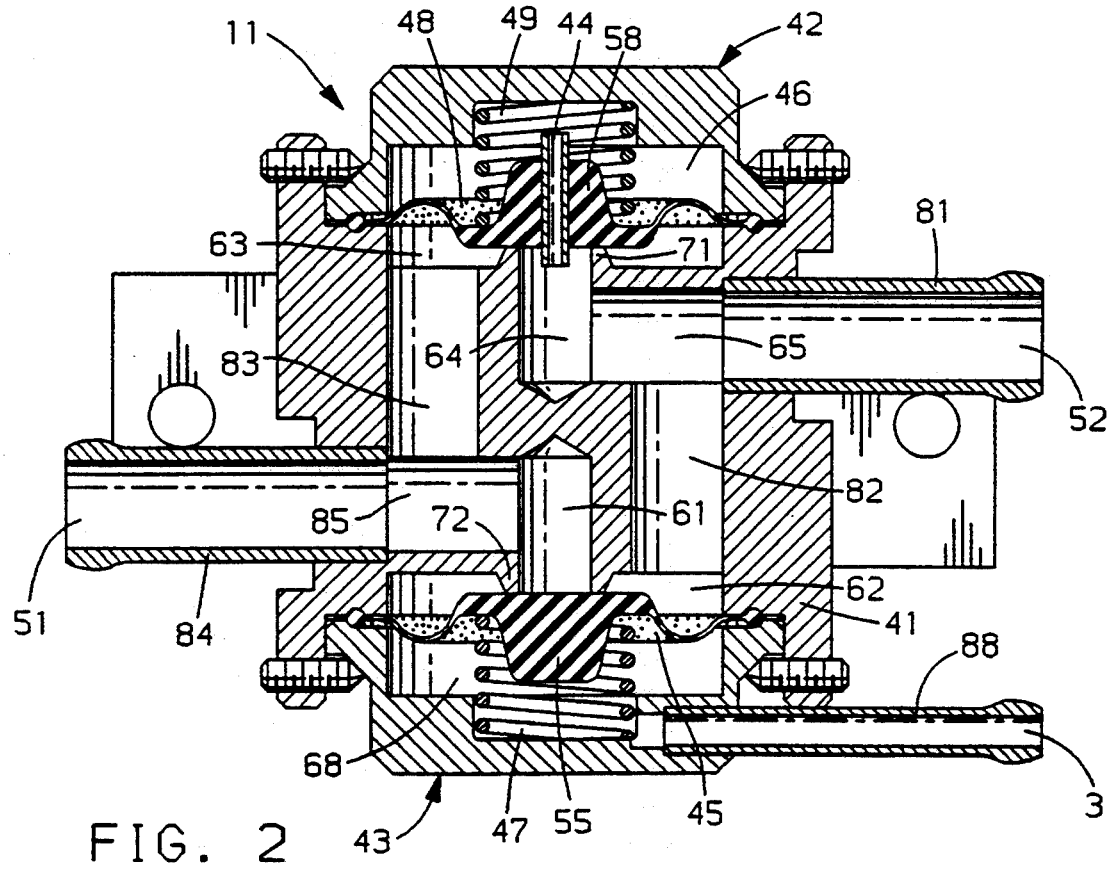
FIG. 2 is a sectional view of the evaporative emission control system's vent valve showing a preferred embodiment of the present invention.

Canister opening 21 is connected to vent line 17 leading to vent valve 11. FIG. 2 illustrates vent valve 11 in greater detail. The main components of vent valve 11 include a housing 41, negative pressure control valve assembly 42, positive pressure control valve assembly with integral engine vacuum actuator 43, atmosphere port 51 and canister port 52. Valve assembly 42 and valve assembly 43 operate as two independent valves to control system pressure. In combination these components provide a mechanism that automatically controls flow between the canister 10 and the atmosphere through ports 51 and 52 of the vent valve 11.

The valve assembly 42 includes a diaphragm 48 that divides the valve into two chambers 46 and 63. The chamber 63 is open to the port 51 and therefore the atmosphere via a conduit comprised of bores 83 and 85 in the housing 41 and a tube 84 fitted to the housing 41. Another conduit provides a flow path from the port 52 to the valve 42. This conduit is comprised of a tube 81 fitted to the housing 41 and bores 65 and. 64 in the housing 41, the end of the bore 64 forming a valve seat 71 coaxially facing the diaphragm 48. The diaphragm 48 carries a valve element 58 adapted for coaction with the valve seat 71. A spring 49 disposed in the chamber 46 biases the diaphragm 48 and the valve element 58 toward the valve seat 71 to establish a normally closed valve condition. An orifice 44 extends through the valve element 58 and provides a flow path between the bore 64 and the chamber 46 so that the pressure in the chamber 46 will track the pressure in the bore 64 which in turn is essentially equal to the system pressure in the canister 10.

The conduit comprised of the tube 81 and bores 65 and 64, the valve 42 and the conduit comprised of the bores 83 and 85 and the tube 84 form a first flow path between the ports 51 and 52. This path is normally closed by the valve 42 as a result of the force of the spring 49 on the diaphragm 48. The diaphragm is moved to unseat the valve element 58 from the valve seat 71 to open the first flow path when the pressure in the chamber 46 is decreased below atmospheric pressure by an amount where the force acting on the diaphragm 48 overcomes the force of the spring 49. This amount is the subatmospheric reference value for the operation of valve 42.

The valve 43 includes a diaphragm 45 that divides the valve into two chambers 62 and 68. The chamber 62 is open to the port 52 via a conduit comprised of a bore 82 and the bore 65 in housing 41 and the tube 81. The chamber 62 is therefore exposed to the pressure in the canister 10 via the conduit 17. The chamber 68 is open to the port 3 via a tube 88 and therefore exposed to the engine manifold 18 pressure through line 19. Another conduit provides a flow path from the port 51 to the valve 43. This conduit is comprised of the tube 84, the bore 85 and a bore 61 in the housing 41, the end of the bore 61 forming a valve seat 72 coaxially facing the diaphragm 45. The diaphragm 45 carries a valve element 55 adapted for coaction with the valve seat 72. A spring 47 disposed in the chamber 68 biases the diaphragm 45 and the valve element 55 toward the valve seat 72 to establish a normally closed valve condition.

The conduit comprised of the tube 81 and bores 65 and 82, the valve 43 and the conduit comprised of the bores 61 and 85 and the tube 84 form a second flow path between the ports 51 and 52 that is in parallel with the first flow path through the valve 42. This second path is normally closed by the valve 43 as a result of the force of the spring 47 on the diaphragm 45. The diaphragm is moved to unseat the valve element 55 from the valve seat 72 to open the second flow path when the pressure in the chamber 68 is decreased below atmospheric pressure by an amount where the force acting on the diaphragm 45 overcomes the force of the spring 47 or when the pressure in the chamber 62 is raised above atmospheric pressure by the amount where the force acting on the diaphragm 45 overcomes the force of the spring 47. These amounts constitute, respectively, the subatmospheric and superatmospheric reference values for the operation of valve 43.

Valve assembly 43 provides two valving functions. When the vehicle's engine is operating a pressure lower than atmospheric is induced in the engine intake manifold 18 creating a vacuum in conduit 19 and in turn in port 3 of vent valve 11. When greater than the reference value, this subatmospheric condition prompts the operation of valve 43. Diaphragm 45 overcomes the force of bias spring 47 unseating the valve element 55 from the valve seat 72. This opens a flow path between chamber 61 and chamber 62 permitting flow between ports 51 and 52 and therefore between the atmosphere and the canister 10. Operating valve 45 in this manner provides a free flow path for purge air to canister 10 when the vehicle is running, whenever operating conditions initiate a purge cycle. Low restriction flow is important to an efficient purge cycle. Such a flow will be induced by the subatmospheric pressure created by the engine manifold vacuum through the canister 10 to purge adsorbent 12 of stored vapors whenever the purge valve 16 is open. Purge valve 16 is opened by the vehicle electronic controller under preset engine operating conditions such as: when the engine is warm, after the engine has been running a specified time, when the vehicle is operating above a specified road speed and when the engine is operating above a specified throttle opening.

When the engine is not operating, valve assembly 43 permits excess pressure that builds up in the evaporative emission control system to vent to atmosphere through port 51, when beyond a threshold level necessary to determine the presence of a leak in the system by a diagnostic mechanism. This serves to avoid high levels of superatmospheric pressure in the system.

As pressure builds above atmospheric in the system due to environmental conditions causing fuel expansion in the storage tank 14 or similar occurrences, the pressure in chamber 62 will unseat valve element 55 from seat 72 when the pressure differential exceeds the force of bias spring 47. The preferred preset force applied by bias spring 47 will be overcome when a superatmospheric pressure of ten inches of water is reached in the system. The amount of pressure necessary to vent the system can be easily varied by changing the bias force of spring 47. When the pressure in the system is more than the preferred superatmospheric reference value of ten inches of water above atmospheric pressure, the system will vent to atmosphere through port 51 of vent valve 11. Flow from the system will pass through canister 10 for exposure to adsorbent 12 and removal of fuel vapors prior to being routed to valve 11 through conduit 17 and vented to the atmosphere.

Valve assembly 42 provides the function of relieving excess negative system pressure beyond a threshold level necessary to detect the presence of a leak in the evaporative emission control system. When the internal system pressure drops below atmospheric, a corresponding drop in pressure will occur in port 52 of vent valve 11 and in chamber 64. This subatmospheric pressure will bleed through orifice 44 to cavity 46. When the subatmospheric pressure is great enough to overcome the force of bias spring 49, valve element 58 will be drawn off seat 71. The preset bias force of spring 49 is preferably overcome when the pressure differential exceeds ten inches of water. This maximum ten inches of water vacuum in the system can be easily varied by changing the amount of bias applied by spring 49.

When valve element 58 is unseated a flow path is opened between chambers 63 and 64 allowing atmospheric air to be drawn into the system relieving excess subatmospheric pressure. As air is drawn into the system it travels through vent valve 11, out port 52, through conduit 17 to the adsorbent bed 12 of canister 10 where stored vapors are stripped from the adsorbent. These vapors then travel through conduit 13 to tank 14 thereby reducing canister adsorbent loading.

The normal biased closed position of valve assemblies 42 and 43 causes positive or negative pressure to build in the evaporative emission control system when the vehicle is parked and ambient conditions change. When ambient conditions vary, a change of pressure within a properly functioning evaporative emission control system can be predicted. This provides a mechanism whereby a diagnostic system can measure the internal system pressure and determine if a leak or other non-preferred condition exists in the evaporative emission control system.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. An evaporative emission control system for a vehicle having an internal combustion engine with an intake manifold and a fuel system, comprising:

a canister having a cavity with a first opening for transferring fuel evaporate between the fuel system and the cavity, a second opening for transferring fuel evaporate from the cavity to the intake manifold and a third opening for venting the cavity to atmosphere; and a vent valve for controlling flow between the cavity and atmosphere including:

a housing having a canister port in communication with the third opening of the canister cavity, an atmosphere port in communication with the atmosphere, an actuator port in communication with the intake manifold and parallel first and second flow paths between the canister port and the atmosphere port:

a first normally closed valve disposed in the first flow path including an operator responsive to subatmospheric pressure in the evaporative emission control system for opening the first normally closed valve;

a second normally closed valve disposed in the second flow path including an operator in communication with the actuator port responsive to superatmospheric pressure in the evaporative emission control system and responsive to subatmospheric pressure in the actuator port from the intake manifold for opening the second normally closed valve.

2. An evaporative emission control system for a vehicle having an internal combustion engine with an intake manifold and a fuel tank, comprising:

a vapor storage canister;

a vapor line connected between the fuel tank and the canister for conveying fuel vapors and air between the fuel tank and the canister;

a vent line connected between the canister and atmosphere, wherein evaporative emission control system internal pressure in the canister is communicated to the vent line;

a purge line connected between the canister and the intake manifold for conveying fuel vapor and air from the canister to the intake manifold;

a vent valve connected to the vent line for controlling flow between the canister and the atmosphere, the vent valve comprising first and second parallel flow paths, the first flow path including a first normally closed valve and a first valve operator exposed to pressure in the vent line and the second flow path including a second normally closed valve and a second valve operator exposed to pressure in the vent line;

a vacuum line connected between the intake manifold and the second valve operator exposing the second valve operator to pressure in the intake manifold;

the first valve operator being responsive to subatmospheric pressure in the evaporative emission control system lower than a first subatmospheric reference value for opening the first normally closed valve thereby enabling flow between the canister and the atmosphere; and the second valve operator being responsive to each of a superatmospheric pressure in the evaporative emission control system exceeding a superatmospheric reference value and a subatmospheric pressure in the vacuum line from the intake manifold lower than a second subatmospheric reference value for opening the second normally closed valve thereby enabling flow between the canister and atmosphere.

3. An evaporative emission control system for a vehicle having an internal combustion engine with an intake manifold and a fuel tank, comprising:

a vapor storage canister;

a vapor line connected between the fuel tank and the canister for conveying fuel vapors and air between the fuel tank and the canister;

a vent line connected between the canister and atmosphere;

a purge line connected between the canister and the intake manifold, the purge line including a normally closed purge valve that is opened during engine operation exposing the canister to subatmospheric pressure in the intake manifold to purge fuel vapor from the canister by enabling air flow therethrough from the vent line to the intake manifold;

a vent valve in the vent line for controlling flow between the canister and the atmosphere, the vent valve comprising first and second parallel flow paths, the first flow path including a first normally closed valve and a first valve operator exposed to pressure in the vent line and the second flow path including a second normally closed valve and a second valve operator exposed to pressure in the vent line;

a vacuum line connected between the intake manifold and the second valve operator exposing the second valve operator to pressure in the intake manifold;

the first valve operator being responsive to subatmospheric pressure in the evaporative emission control system lower than a first subatmospheric reference value for opening the first normally closed valve thereby enabling flow between the canister and the atmosphere; and the second valve operator being responsive to each of a superatmospheric pressure in the evaporative emission control system exceeding a superatmospheric reference value and a subatmospheric pressure in the vacuum line from the intake manifold lower than a second subatmospheric reference value for opening the second normally closed valve thereby enabling flow between the canister and atmosphere, whereby flow between the canister and atmosphere is enabled when the vent valve is opened in response to subatmospheric pressure in the intake manifold lower than the second subatmospheric reference value during engine operation and when the pressure in the evaporative emission control system exceeds the superatmospheric reference value or is lower than the first subatmospheric reference value to enable collection and purging of fuel vapor and the vent valve being closed when the engine is off and the pressure in the evaporative emission control system is between the superatmospheric reference value and the first subatmospheric reference value to enable diagnosis of the evaporative emission control system.

4. An evaporative emission control system for a vehicle having an internal combustion engine with an intake manifold and a fuel tank, comprising:

a vapor storage canister;

a vapor line connected between the fuel tank and the canister for conveying fuel vapors and air between the fuel tank and the canister;

a vent line connected between the canister and atmosphere;

a purge line connected between the canister and the intake manifold, the purge line including a normality closed purge valve that is opened during engine operation exposing the canister to subatmospheric pressure in the intake manifold to purge fuel vapor from the canister by enabling air flow therethrough from the vent line to the intake manifold;

a vent valve in the vent line for controlling flow between the canister and the atmosphere, the vent valve comprising first and second parallel flow paths, the first flow path including a first normally closed valve and a first valve operator exposed to pressure in the vent line and the second flow path including a second normally closed valve and a second valve operator exposed to pressure in the vent line;

a vacuum line connected between the intake manifold and the second valve operator exposing the second valve operator to pressure in the intake manifold;

the first valve operator including a first diaphragm having a first valve element with an orifice therethrough biased toward a first valve seat by a first spring;

the first valve operator being responsive to subatmospheric pressure in the evaporative emission control system lower than a first subatmospheric reference value equal to the spring's biasing force for opening the first normally closed valve thereby enabling flow between the canister and the atmosphere;

the second valve operator including a second diaphragm having a second valve element biased toward a second valve seat by a second spring; and the second valve operator being responsive to each of a superatmospheric pressure in the evaporative emission control system exceeding a superatmospheric reference value equal to the second spring's biasing force and a subatmospheric pressure in the vacuum line from the intake manifold lower than a second subatmospheric reference value equal to the second spring's biasing force for opening the second normally closed valve thereby enabling flow between the canister and atmosphere, whereby flow between the canister and atmosphere is enabled when the vent valve is opened in response to subatmospheric pressure in the intake manifold lower than the second subatmospheric reference value during engine operation and when the pressure in the evaporative emission control system exceeds the superatmospheric reference value or is lower than the first subatmospheric reference value to enable collection and purging of fuel vapor and the vent valve being closed when the engine is off and the pressure in the evaporative emission control system is between the superatmospheric reference value and the first subatmospheric reference value to enable diagnosis of the evaporative emission control system.

* * * * *